United States Patent [19]
Brandt et al.
[11] Patent Number: 4,478,585
[45] Date of Patent: Oct. 23, 1984

[54] INBOARD OUTBOARD DRIVE AND MOUNTING SHIELD THEREFOR

[75] Inventors: Lennart Brandt, Fjärås; Heinz Pichl, Upsala, both of Sweden

[73] Assignee: AB Volvo Penta, Gothenburg, Sweden

[21] Appl. No.: 461,876

[22] Filed: Jan. 28, 1983

[30] Foreign Application Priority Data

Feb. 2, 1982 [SE] Sweden ..... 82006032

[51] Int. Cl.³ ..... B63H 5/06
[52] U.S. Cl. ..... 440/112; 440/52; 248/558; 277/63; 384/441; 403/3
[58] Field of Search ..... 440/88, 89, 75, 61, 440/111, 112; 277/58, 59, 63, 65, 152, 153; 308/187, 187.1; 384/215, 428, 439, 441; 248/558; 403/3, 4, 194, 199, 201, 238

[56] References Cited

U.S. PATENT DOCUMENTS

| | | | |
|---|---|---|---|
| 3,204,598 | 9/1965 | Sharp | 440/112 |
| 3,669,057 | 6/1972 | Shimanckas | 440/112 |
| 3,834,344 | 9/1974 | Yoshino | 440/112 |
| 4,040,378 | 8/1977 | Blanchard | 440/112 |

*Primary Examiner*—Trygve M. Blix
*Assistant Examiner*—Patrick W. Young
*Attorney, Agent, or Firm*—Arthur G. Yeager

[57] ABSTRACT

An inboard outboard drive having a structural part which passes through an opening in the hull of a boat. A mounting shield for supporting the structural part is at its inner portion provided with symmetrical receiver grooves into which the support flanges on the structural part may be selectively inserted in either one of two reversed positions and has in an outer portion an asymmetrically located flange for securing to the hull. The shield may according to need be put on the inner or outer side of the hull, depending on which of them is more even than the other.

20 Claims, 8 Drawing Figures

Fig. 4
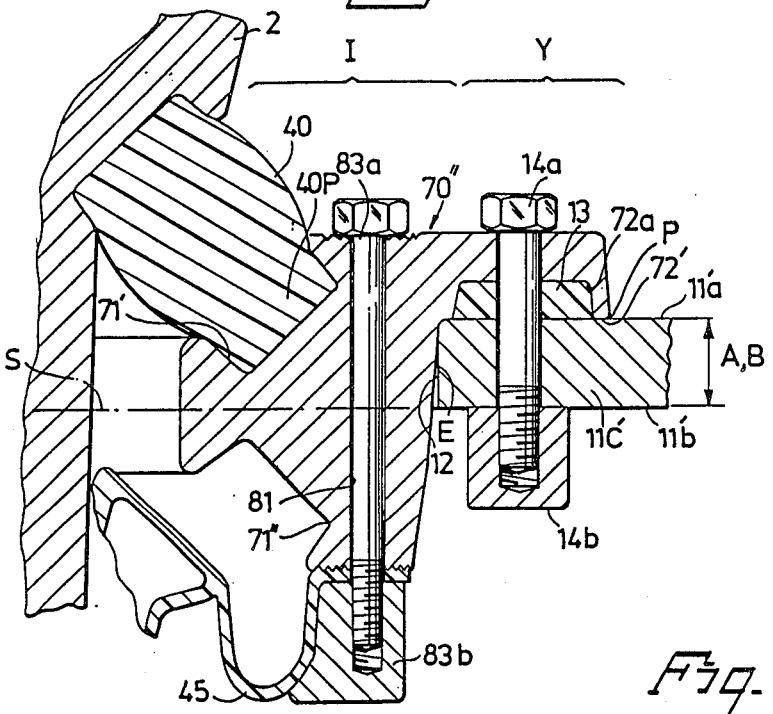
Fig. 6
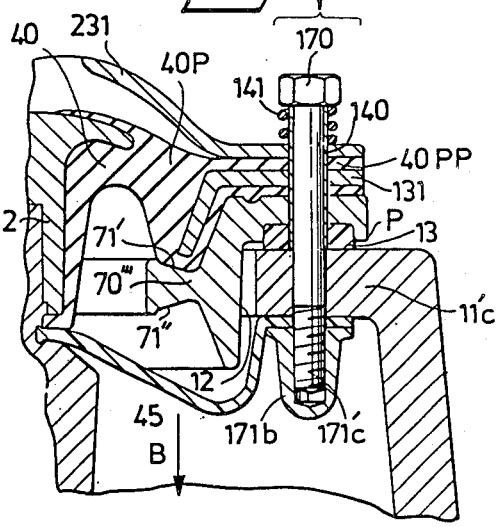
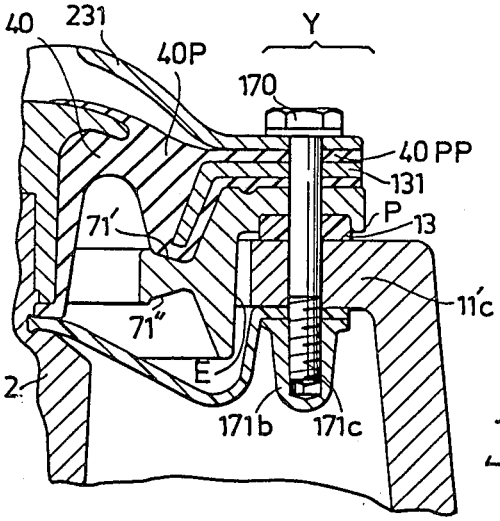
Fig. 5

INBOARD OUTBOARD DRIVE AND MOUNTING SHIELD THEREFOR

RELATED APPLICATIONS

This application is related to the applicants' related applications entitled: Inboard Outboard Drive; U.S. Ser. No. 461,877 and Inboard Outboard Drive and Mounting Therefor, U.S. Ser. No. 461,962 both filed on Jan. 28, 1983 corresponding to (Swedish applications Nos. SE 8200600, SE 8200601, SE 8200602; and SE 8200604.

FIELD OF INVENTION

This invention relates to inboard outboard drives and particularly to a mounting shield therein for the supporting means on a structural part or housing of the inboard outboard drive which passes through an opening in the shell of the hull of a boat.

DESCRIPTION OF THE PRIOR ART

The prior art has used mounting shields for supporting a structural part, a propeller leg or housing, of an inboard outboard drive which passes through an opening in the shell of the hull of a boat in order to transmit the torque to the propeller. In inboard outboard drives of the S-type, e.g. U.S. Pat. No. 3,896,757 –Kucher, July 29, 1975, where the upper portion of the lower unit may be placed inboard, the opening is arranged in the bottom of the hull and said structural part is this lower unit. In inboard outboard drives of the Z-type, e.g. U.S. Pat. No. 3,626,467 –Mazziott, Dec. 7, 1971, the opening is in the transom of the boat and said structural part is the connecting part between the engine of the drive and the lower unit which is located completely outboard. The periphery of the opening may be braced by a shield fastened to the hull.

When boat hulls are produced of reinforced fiberglass plastics, an even or smooth surface (gel-coat face) is obtained on the side which defines the outer face of the hull, and a coarser or rougher surface is obtained on the other side, which is the inner face of the hull. The portion of the hull which immediately surrounds the opening, generally called a motor bedding, may have the smooth surface either on the outside, or on the inside, depending exclusively on the production technology. Because the mounting shield, for proper sealing attachment, always has to be put on the even surface, it has been necessary to provide two different shields for each drive, one shield for affixing on the outside of the hull, and one for affixing to the inside of the hull, depending on which type of a hull the drive is mounted on.

SUMMARY OF THE INVENTION

The object of the invention is to provide in an inboard outboard drive an improved mounting shield and support means for mounting and sealing the structural part of the inboard outboard drive which passes through an opening in the hull to the hull at the opening. The mounting shield braces the hull at the periphery of the opening. The mounting shield and support means has vibration damping means between the hull and structural part so vibration and noise are damped or not transmitted from the motor and drive to the hull. The shield is fastened to the hull with screw bolts and sealed by silicone O-rings, etc. The support means, a resilient element, e.g. rubber, between the hull and structural part provides sealing and vibration damping functions.

The improved shield construction provides for selectively placing the mounting shield for sealing and attachment on either the outside or the inside of the hull without appreciably or any change of the mounting shield structure or the structure and mutual position of the hull and the structural part passing through the opening in the hull or the mounting means on the structural part.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

The invention is explained with the aid of the following schematic views.

Figure 2:
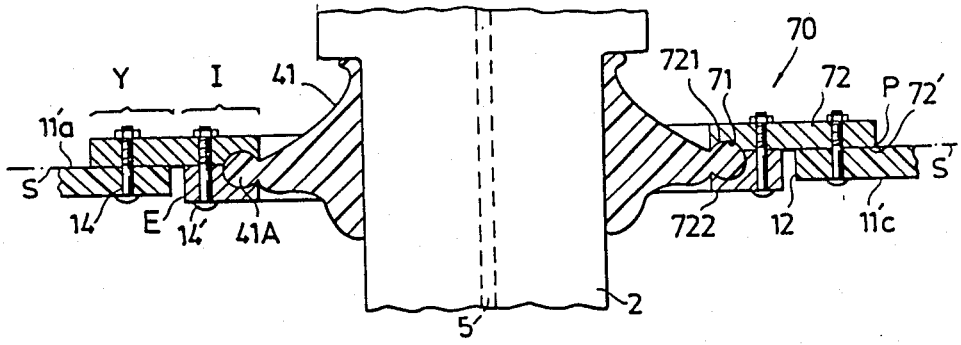
Figure 3:
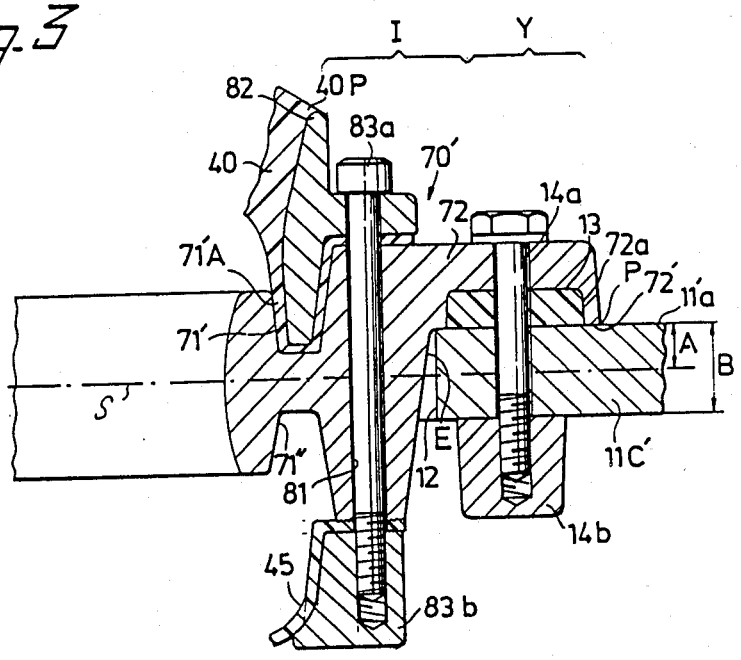
Figure 7:
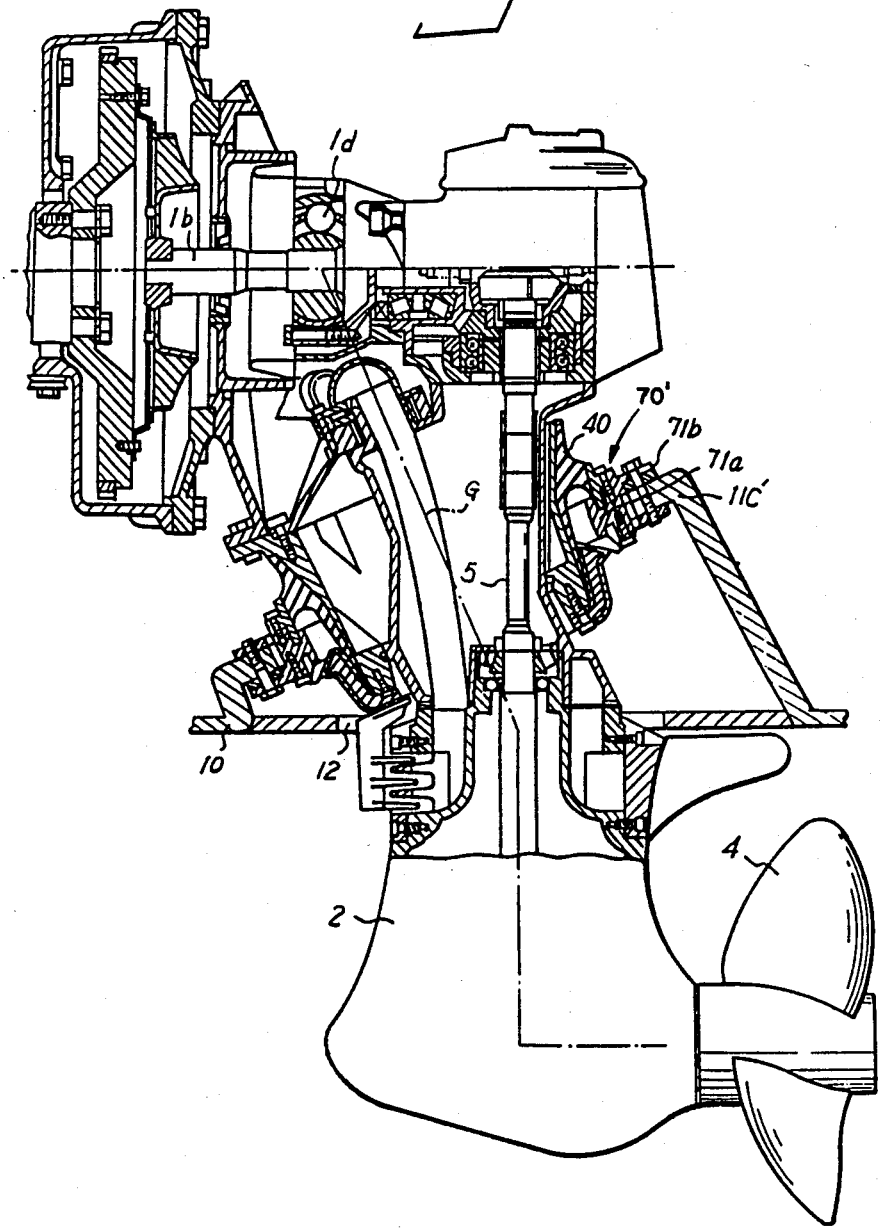

FIG. 2 is an axial cross-section through a first embodiment;

FIGS. 3 and 4 shown in axial cross-section on a larger scale through the peripheric portion of FIG. 2 a second and third embodiment;

FIGS. 5 and 6 show in axial cross-section the peripheric portions of a fourth and a fifth embodiment; and FIG. 7 is an axial cross-section on a smaller scale through an S-drive according to the invention.

Identical or analoguous reference signs are used in all drawing figures for parts having the same function.

DESCRIPTION OF THE PREFERRED EMBODIMENTS

Figure 1A:
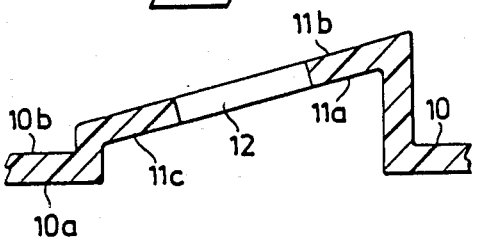
Fig. 1a PRIOR ART
FIGS. 1*a* and 1*b*, PRIOR ART, schematically show in cross section, two known types of a bedding for an inboard/outboard drive of the S-type.
Figure 1B:
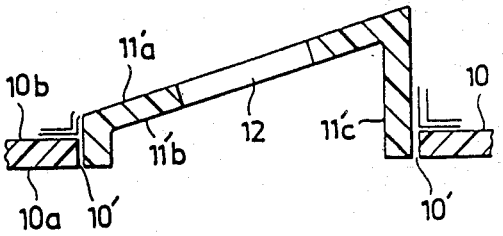

According to FIGS. 1*a* and 1*b*, the bottom 10 of a hull has an even gel-coat surface 10*a* on the outside, and a coarser surface 10*b* on the inside, and is provided with a break 12. If bedding 11C is according to FIG. 1*a* produced integrally with the hull with the aid of blocks inserted into the mold for the hull, the bedding 11C has also an even gel-coat surface 11*a* at the inside and a coarser surface 11*b* on the outside.

If, however, bedding 11C' is according to FIG. 1*b* produced so that a separate part is along joints 10' attached to the bottom 10 of the hull, then the even surface 11'*a* will lie on the inner side of bedding 11C', and the coarser surface 11'*b* on the outside. This production technology is known.

According to FIG. 2, the lower unit 2 of an inboard/outboard drive, which otherwise is not shown, is attached to an annular resilient element or support means 41 which supports the lower unit 2 and which in its turn is fixed to the bedding 11C' with the aid of an annular mounting shield 70 according to the present invention. In the lower unit extends, among other things, a power transmitting shaft 5. Mounting shield 70 has on the one hand an inner portion I with such a dimension on the outer periphery E, that it may be accommodated in the break 12, and on the other hand an outer portion Y which protrudes beyond the periphery of the break 12 and defines a flange 72. Flange 72 is provided with a contact surface 72' with which it may be selectively affixed to the inner or outer surface of a hull and in known manner screwed-on with the aid of retaining screws 14. The inner portion I of the shield comprises a receiver means for the resilient element 41. In the embodiment shown, the receiver means is defined by a single profiled groove 71, and the resilient element 41 is at its outer periphery provided with a bulge 41A having in profile a shape complementary to the groove 71. The bulge 41A, i.e. the outer periphery of the resilient element 41, defines thus a support means for the lower unit 2.

The profile shape of the groove 71 is symmetrical in regard of a plane of symmetry S which in the example shown coincides with the plane in which contact surface 72', and also the peripheric edge thereof, which also defines the peripheric edge P of the whole shield, lie. The inner portion I of the shield is divided and both parts 721, 722 are held together by screw bolts 14' tightened when the bulge 41A on the resilient element 41 has been introduced into the groove 71.

Although the contact face 72' of the flange 72 lies in said plane of symmetry S, the body of the flange 72 is assymetrically displaced in regard to this plane of symmetry. Due to the fact that the space beneath the flange 72 and next to the outer periphery E of the inner portion I is free, the shield 70 may be selectively put on the inner or the outer face of a hull. When the shield shall be affixed to the outer face, i.e. turned upside down in regard of the position shown in FIG. 2, the resilient means 41 is set into the groove 71 in unchanged position in regard of the hull, i.e. in the same position as shown in FIG. 2, which is possible without further precautions or change due to this construction with the symmetrical profile of the groove 71.

The annular mounting shield 70' of FIG. 3 is at its inner portion I provided with a receiver means comprising two identical profiled grooves 71', 71'' which are disposed in mirror-inverted relationship one to another and at equal distances from the plane of symmetry S of the receiver means. Shield 70' has in its outer portion Y a flange 72 having contact face 72' in which a recess **72*a* is provided for a sealing (packing, O-ring) 13. Contact face 72' is located at a predetermined distance A from the plane of symmetry S, and in the example shown, distance A is essentially equal to half the thickness B of the hull, more precisely of the bedding 11C'. The flange 72 is in a known manner attached to the hull with the aid of screw bolts 14*a* which pass through smooth holes in the hull and are screwed into nut means 14*b***.

In the example shown, shield 70' is used with a bedding 11C' having an even surface **11'*a* turned inside. The flange 72 is therefore affixed to the bedding at the inner side thereof and a resilient element 40 is with its outer peripheric portion 40P inserted into a profiled groove 71', the upper groove in the drawing, where it is retained by a first annular frame 82 which is secured to the shield 70' with the aid of screw bolts 83*a* which pass through smooth holes 81 in the shield and are screwed into threaded holes in a second annular frame 83*b*. Between the shield 70' and the second annular frame 83*b* is a thin sealing membrane 45**, e.g. of rubber, clamped at its periphery.

It will be observed that the portion of the shield 70', more precisely of the inner portion I of the shield, through which the screw bolts **83*a* pass, is symmetrical in regard of the plane of symmetry S. The outer portion Y, i.e. the flange 72, is not symmetrical. It will be easily understood that the shield 70', in accord with the arrangement described, may with equal ease be threaded on to the outer side of a hull, if this is even, by turning the whole shield 70' upside down, and inserting the resilient means 40 and the first annular frame 82 in the other groove 71''. The resilient means 40, and thereby also the lower unit 2 (FIG. 2**) supported thereby, retain their relative positions in regard of the plane of symmetry S and also in regard of the hull, because the plane of symmetry S retains its relative position in regard of the hull, in accord with the earlier stated relation A=0.5B.

In the alternate embodiment of the shield 70'' according to FIG. 4 the resilient means 40 and the sealing membrane 45 have a modified shape and further are the distances A and B equal, which means that when the shield 70'' is turned to be threaded-on to the outer side of the hull, its plane of symmetry S, which in the drawing touches the outer surface **11'*b* of the bedding 11C', will lie at the level of the inner side of the hull. This results in the resilient means 40, and the lower unit 2 supported thereby, moving into a somewhat changed position relative to hull 10**.

The outer peripheric portions 40P of the resilient element 40 also define in the embodiment according to FIGS. 3 and 4 a support means for the lower unit 2.

According to FIGS. 5 and 6, the inner portion of an annular resilient element 40 is attached to the lower unit 2, the outer peripherical portion 40P rests in the groove 71' and the outermost peripheric portion 40PP is with the aid of screw bolts 171C affixed to the outer peripheric portion Y of the mounting shield 70'' and is together with this, and with the aid of nuts **171*b*, attached to the bedding 11C'. Because of the said fixation by screws, the function of the groove 71' is essentially to take up pressure stress. A bracing element, defined by a rigid, e.g. metallic, ring with a downward bend profile, is located inside the outer perimeter portion of resilient means 40. A peripheric cap 231, also rigid, is located on the outer face of resilient means 40 which in the drawing lies or faces upwardly and has a somewhat more upward and outward bend profile than element 40. Bracing element 131 and cap 231 are attached with the aid of the same screws 14*a* as the resilient means 40 and the mounting shield 70'''. The bracing element 131, affixed by retaining screws 171*c* or 171*c'*, also fills the same function as the first annular frame 82 of FIG. 3, attached by separate screws 83*a*, i.e. to retain in a safe way the resilient means 40 in the respective groove 71', 71''**.

The device of FIG. 6 differs from the device of FIG. 5 in that the retaining screws **171*c'* are longer and protrude from the cap 231. They have sleeves 140 slipped on which transmit pressure from the screw head 170 to the mounting shield 70''' whereby the screws 171*c'* upon tightening of the nuts 171*b* are firmly anchored in the bedding 11C'. On the protruding portions of the sleeves 140 are strong helical springs 141 slipped on which rest against the screw heads 170 and against the cap 231. Thereby are all parts through which the sleeves 140 pass, i.e. the packing 13, the shield 70''' itself, the resilient element 40, the bracing element 131, and the peripheric cap 231** subject to a constant elastic pressure.

When the shield 70''' shall be put on the hull from the outside, the retaining screws **171*c* or 171*c'* keep their orientation as shown in FIGS. 5 and 6, i.e. with the screw heads inboard, and the resilient element 40 is inserted in the groove 71'' so that it will with its perforated outermost peripheric portion 40PP immediately rest on the coarse inboard surface 11***b* of the bedding 11C (FIG. 1*a*).

In FIG. 7, on a smaller scale, there is shown an axial cross-section through an inboard/outboard drive of the S-type according to the invention, which is provided with a resilient element 40 according to FIG. 3 and which is side-steerable around an inclined steering axis G. This inclined steering axis G passes through a universal joint 1*d* due to the fact that the mounting shield 70', in which the resilient element 40 is inserted, is attached to a bedding 11C' which is mounted on the bottom of the hull with necessary inclination.

The mounting shield according to the invention may be in plan view either circular or annular, or at least symmetrical in regard of a plan, e.g. the drawing plane of FIG. 2, and have e.g. elliptic or rectangular shape.

It will be appreciated that the mounting shield according to the invention also, and in an unchanged manner, can be used when no resilient supporting means is provided around the part which passes through the break, and this part itself is provided with a rigid supporting means for engagement with the receiver means of the mounting shield, e.g. a rigid bulge similar to the bulge 41A.

Also further modifications, not shown in the drawings, are possible within the scope of the invention, e.g. the shield 70 of FIG. 2 may be made undivided, and/or the groove 71 may have some other shape in profile.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An inboard/outboard drive for use in a boat having an opening in the shell of the hull, comprising a structural part passing through the opening in the hull, support means attached to said structural part for supporting said structural part, a mounting shield having an inner annular portion and an outer portion, said inner annular portion having an outer periphery which is accommodated in the opening, said inner portion having receiver means for receiving said support means to carry said structural part, said receiver means is symmetrical relative to a plane of symmetry parallel with a plane in which the outer peripheric edge of said mounting shield lies, said outer annular portion is substantially defined by a flange having a body which is displaced to one side in regard to said plane of symmetry and which, on its side located closer to said plane of symmetry, is provided with a contact face for sealing contact with an even face of the hull.

2. The invention defined in claim 1 wherein said receiver means is defined by a single profiled annular groove centered in said plane of symmetry, and said support means having an outer portion fitting in said groove.

3. The invention defined in claim 1 wherein said receiver means is defined by two annular grooves with identical profiles located in mirror inverted relationship on opposite sides of said mounting shield and equally spaced on opposite sides of said plane of symmetry, and said support means having an outer peripheral portion seating in the upper one of said grooves.

4. The invention defined in claim 1 and said contact face lying essentially in the plane of symmetry.

5. The invention defined in claim 1 and said contact face lying parallel and at a distance from the plane of symmetry which essentially is equal to one half the thickness of the hull.

6. The invention defined in claim 1 and said contact face lying parallel to and at a distance from the plane of symmetry which is essentially equal to the thickness of the hull.

7. The invention defined in claim 1, said support means having an annular resilient means, and said receiver means being shaped for receiving said resilient means for supporting said support means.

8. The invention defined in claim 7 further comprising rigid fixing means cooperating with said resilient means at its outer perimeter to retain said resilient means in said receiving means, and screws connecting and fastening said rigid fixing means to said mounting shield.

9. The invention defined in claim 1 further comprising holes in the flange part of the outer portion of said mounting shield and holes in the outermost peripheric portion of said support means, said holes being aligned for retaining screws for securing said support means and mounting shield to the hull.

10. The invention defined in claim 9 further comprising spring means mounted on said retaining screws to constantly press said mounting shield against the hull.

11. The invention defined in claim 1 wherein said support means has an outer resilient means having an annular bulge at the periphery, said mounting shield having a wide annular member in both said inner and outer annular portions and a narrow annular member in said inner annular portion in face contact with the inner annular portion of said wide annular member, fastening means to secure said wide and narrow annular members together, said receiver means being provided by a groove at the inner perimeter and in the facing sides of said wide and narrow annular portions so the grooves face each other and clamp said annular bulge when said fastening means is fastened to secure said mounting means and support means together, the grooves are symmetrical about the plane of symmetry and the contact face on said flange in the outer portion of the wide annular member is in said plane of symmetry so said mounting shield may be fastened with said contact face engaging the inside or outside surface of the hull and said plane of symmetry, which remains constant with said support means, only moves from the one of the inside or outside surfaces of the hull to the other.

12. The invention defined in claim 1 wherein said support means has an outer resilient portion, said receiver means has a pair of annular grooves on opposite sides of and facing in opposite directions relative to said mounting shield having mirror image profiles and being equally spaced on opposite sides of the plane of symmetry, fixing means fitting in the periphery of the one said resilient portion and of said grooves in which said resilient portion is seated, first fastening means for securing said fixing means to said mounting shield to secure said support means to said mounting shield, said contact face on said flange having sealing means and being displaced from the plane of symmetry one half the thickness of the hull so on reversal of said mounting shield from said flange engaging the inside of the hull to engaging the outside of the hull the plane of symmetry, and thus the position of said support means in the other groove, remains the same relative to the hull, and second fastening means securing and sealing said mounting shield at said flange at the other perimeter to the hull.

13. The invention defined in claim 12, and said first fastening means being an annular series of screw fasteners in aligned holes in said fixing means, and said inner annular portion of said mounting shield and said second fastening means being an annular series of screw fasteners in aligned holes in said flange and the hull.

14. The invention defined in claim 12, and said first and second fastening means being a single annular series of screw fasteners in aligned holes in said fixing means, said resilient portion, said outer annular portion of said mounting shield and the hull.

15. The invention defined in claim 14, and said single annular series of screw fasteners having a machine screw extending through said fixing means, said resilient portion, said outer annular portion of said mounting shield and the hull, a head spaced above said fixing means, a sleeve mounted on said machine screw engaging said head and one side of the hull, spring means between said head and said fixing means and nut means on said screw means for engaging the other side of the hull for tight engagement of said head against said sleeve and said sleeve against said hull to compress said spring means a predetermined distance to provide a predetermined constant pressure engaging said fixing means, resilient means, mouting means and hull.

16. The invention defined in claim 1 wherein said support means has an outer resilient portion, said receiver means has a pair of annular grooves on opposite sides and facing in opposite directions relative to said mounting shield and having mirror image profiles and being equally spaced on opposite sides of the plane of symmetry, fixing means fitting in the periphery of said resilient portion and the one of said grooves in which said resilient means is seated, first fastening means for securing said fixing means to said mounting shield to secure said support means to said mounting shield, said contact face on said flange having sealing means and being displaced from the plane of symmetry the thickness of the hull so, on reversal of said mounting shield from said flange engaging the inside of the hull to engaging the outside of the hull, the plane of symmetry moves from alignment with the outside of the hull to alignment with the inside of the hull, and second fastening means securing and sealing said mounting shield at said flange to the hull.

17. The invention defined in claim 1 further comprising annular sealing means engaging said structural part and extending outwardly therefrom to form a seal.

18. The invention defined in claim 7 further comprising annular sealing means disposed on the opposite side of said receiver means from said annular resilient means, said sealing means engaging said structural part and extending outwardly therefrom to form a seal.

19. The invention defined in claim 1 wherein said support means includes annular resilient means, said receiver means being shaped for receiving said resilient means and supporting same, rigid fixing means cooperating with said resilient means for retaining said resilient means in said receiving means, and spaced screw means connecting said rigid fixing means to said mounting shield.

20. The invention defined in claim 1 wherein said flange of said outer annular portion includes spaced holes therethrough, said support means having an annular resilient means, said resilient means including spaced holes respectively aligned with said holes of said flange, a peripheric cap and said receiver means sandwiching therebetween said resilient means, said cap having spaced holes respectively aligned with said holes of said flange and resilient means, and screw means passing respectively through said aligned holes for securing said cap, flange and resilient means to the hull.

* * * * *